US005581241A

United States Patent [19]

Kaufman et al.

[11] Patent Number: 5,581,241

[45] Date of Patent: Dec. 3, 1996

[54] ULTRA-SENSITIVE SMOKE DETECTOR

[75] Inventors: Michael Kaufman, Cleveland Heights; Richard W. Thomas, Bedford, both of Ohio

[73] Assignee: Voice Products Inc., Cleveland, Ohio

[21] Appl. No.: 289,659

[22] Filed: Aug. 12, 1994

[51] Int. Cl.[6] ..... G08B 17/10

[52] U.S. Cl. ..... 340/630; 340/628; 340/629; 356/339; 250/573; 250/574

[58] Field of Search ..... 250/573, 574, 250/575; 356/338, 339; 340/628, 629, 630

[56] References Cited

U.S. PATENT DOCUMENTS

| | | | |
|---|---|---|---|
| 3,799,670 | 3/1974 | Kohr | 340/630 |
| 3,914,616 | 10/1975 | Mooibroek | 340/630 |
| 4,025,915 | 5/1977 | Enemark | 340/237 |
| 4,121,110 | 10/1978 | Solomon | 250/574 |
| 4,181,439 | 1/1980 | Tresch et al. | 356/338 |
| 4,221,485 | 9/1980 | Schulze | 356/338 |
| 4,469,953 | 9/1984 | Fujisawa et al. | 250/574 |
| 4,678,921 | 7/1987 | Nakamura et al. | 250/574 |
| 4,754,150 | 6/1988 | Orioka et al. | 250/574 |
| 4,758,733 | 7/1988 | Mochizuki | 250/574 |
| 4,769,550 | 9/1988 | Dolnick | 250/574 |
| 4,857,895 | 8/1989 | Kaprelian | 340/630 |
| 4,906,978 | 3/1990 | Best et al. | 340/630 |
| 5,008,559 | 4/1991 | Beyersdorf | 250/575 |
| 5,381,130 | 1/1995 | Thuillard et al. | 340/630 |

FOREIGN PATENT DOCUMENTS

| | | | |
|---|---|---|---|
| 4042054 | 7/1992 | Japan | 340/630 |

OTHER PUBLICATIONS

Jonathan Dahl, *Disney Could Jump on This Idea By Offering a Jimminy Cricket Line,* The Wall Street Journal, Thursday, Aug. 12, 1993.

*Primary Examiner*—Jeffery Hofsass
*Assistant Examiner*—Ashok Mannava
*Attorney, Agent, or Firm*—Donald A. Bergquist

[57] ABSTRACT

A smoke detector that operates on the principle of scattered light is disclosed that has the capability of an operating sensitivity that is tens of times greater than that of smoke detectors presently available. Plural light sources are used, their light rays directed radially toward the center of a cylindrical detector chamber having a mirrored wall that reflects light back toward the chamber's center, thereby to brightly illuminate a central detection zone. Scattered light from smoke in this zone is detectable by a photocell at right angles to the converging multiple light rays. To obtain highly improved stability of the light output that enables ultra-high sensitivity, the light sources are light-emitting diodes in series connection and they are driven by a very stable constant voltage source that also powers the photocell detector. This system gains impressive sensitivity while reducing nuisance alarms that have been a common problem regarding efforts to increase smoke detector sensitivity. Whereas the goal of this invention is to improve the public safety, improvements are presented in smoke collection also, whereby ambient air is quickly and efficiently brought to the detector cell itself using convection currents that are enhanced by the aerodynamic design of the housing surrounding the cell.

9 Claims, 5 Drawing Sheets

ULTRA-SENSITIVE SMOKE DETECTOR

INTRODUCTION

This invention relates to apparatus for the detection of smoke or other particulate matter suspended in air or another gaseous medium. More particularly, it relates to optical smoke detectors, as opposed to those smoke detectors that utilize a source of ionizing radiation as a part of their smoke detecting mechanism. Even more particularly, it relates to those optical smoke detectors that use the principle of light scatter. Still more specifically, this invention describes a smoke detector that uses various design elements to achieve a sensitivity that can be one-hundred times greater than that of any existing detector, without increasing nuisance alarms.

BACKGROUND

The purpose of smoke detection within dwellings is to give occupants an early warning of potentially hazardous fires. In the event of a fire, the amount of advance warning time provided to save lives and property is directly related to the sensitivity of the smoke detector that is in service.

Existing smoke detectors in the prior art have not been able to increase the sensitivity substantially without simultaneously increasing the tendency to produce nuisance alarms. In fact, some prior art inventions relate to schemes only for reducing nuisance alarms.

Ionization smoke detectors are prone to nuisance alarms because of their detection of as "smoke", mostly polar molecules including water vapor, moisture, and humidity. Therefore, this technology is viewed as being at its sensitivity limit. Optical light scatter smoke detectors, however, are not so sensitive to water vapor and are therefore not so prone to nuisance alarms as are ionization detectors.

For a light scatter detector to achieve maximum sensitivity, it needs to get as much light as possible into the detection zone. The prior art addressing the sensitivity of light scatter smoke detectors relate to concentrating and focusing (typically using a lens) a single light source on a single spot in the detection zone. They do not consider the use of multiple light sources to increase light intensity. They also do not consider the use of reflective surfaces to concentrate the light. This is probably because they could not determine how to configure the multiple light sources and detector in a way that did not also produce excessive noise light that impairs the detector's ability to distinguish light scattered from particles.

In addition, all smoke detectors rely upon quickly collecting the smoke or other particulate matter from the atmosphere being monitored and into the detection chamber. No prior art found addresses the smoke collection aspect of the smoke detector design. Prior art does not address the use of aerodynamic principles to improve smoke collection.

The technology of the present invention was originally developed to detect the presence of cigarette smoke to enforce smoking restrictions. Cigarette smoke is much less concentrated than is the smoke from a fire, so an ultra-sensitive detector was required. The prior art did not appear to achieve the high level of sensitivity and the resulting improved public safety, partly because of the problem of nuisance alarms.

SUMMARY OF THE INVENTION

Thus it is an object of this invention to provide a smoke detector that employs a photocell for detecting light scattered at a substantially 90° angle from a plethora of light beams, both direct and reflected, that intersect and cross in a myriad of angles within a thus brightly illuminated central region of a circular cylindrical detection chamber comprising a cylindrical wall having a continuous mirrored internal surface that reflects nearly 100% of incident light impinging thereupon.

It is another object of this invention to provide such a smoke detector wherein said continuous mirrored internal surface is interrupted only by openings that provide means for one or more light sources to introduce light into said detection chamber.

It is another object of this invention to provide such a smoke detector having such openings for introducing light wherein the principal axis of the collection of rays of light introduced is directed radially toward the center of said detection chamber.

It is another object of this invention to provide a smoke detector as thus-far described wherein three light sources are spaced in a co-planar fashion at equal intervals around the circumference of said detection chamber in said spaced openings for the introduction of light into said detection chamber.

It is another object of this invention to provide a smoke detector as thus-far described wherein each said light source is a light-emitting diode (LED).

It is another object of this invention to provide a smoke detector as thus-far described wherein each said LED is fitted with a reflector ring to re-direct light emitted transverse to the major axis of the LED to a direction substantially aligned with said major axis.

It is another object of this invention to provide a smoke detector as thus-far described wherein said LEDs are connected in series and are powered by a single power source of precisely regulated constant voltage, thereby to provide plural light sources of constant intensity with a very low degree of baseline temperature drift.

It is another object of this invention to provide a smoke detector having a doubly-convex disc-shaped detector cell body portion that increases the rate at which natural ambient convection currents carry smoke into the detection chamber.

It is another object of this invention to provide a smoke detector having such a doubly convex body, a base, and a cover wherein said base and cover each also includes a light baffle to prevent ambient light from entering said detection cell.

It is yet another object of this invention to provide a smoke detector as thus-far described wherein the detection threshold for detecting smoke or other particulate matter in a gas is possible to be one one-hundredth that of smoke detectors that are currently in common use, as measured by Underwriter's Laboratories UL® STANDARD 217.

DETAILED DESCRIPTION OF THE INVENTION

This invention deals with several features of smoke detectors of the light-scattering-type, each feature being improved upon by at least an incremental amount. The use of all of the individual incremental improvements, however, results in a net improvement that appears greater than the sum of the benefits from the individual incremental improvements.

First, for any smoke detector to detect smoke in the environs in which it is placed, air (herein, we use the term "air", which is indeed a mixture of gases, with the understanding that any gas or gas mixture could be present in the air or in place of the air) must transport the smoke (herein, we use the term "smoke" to represent any particulate matter, whether liquid or solid, suspended in air) to the detector cell within the smoke detector apparatus.

Figure 1:
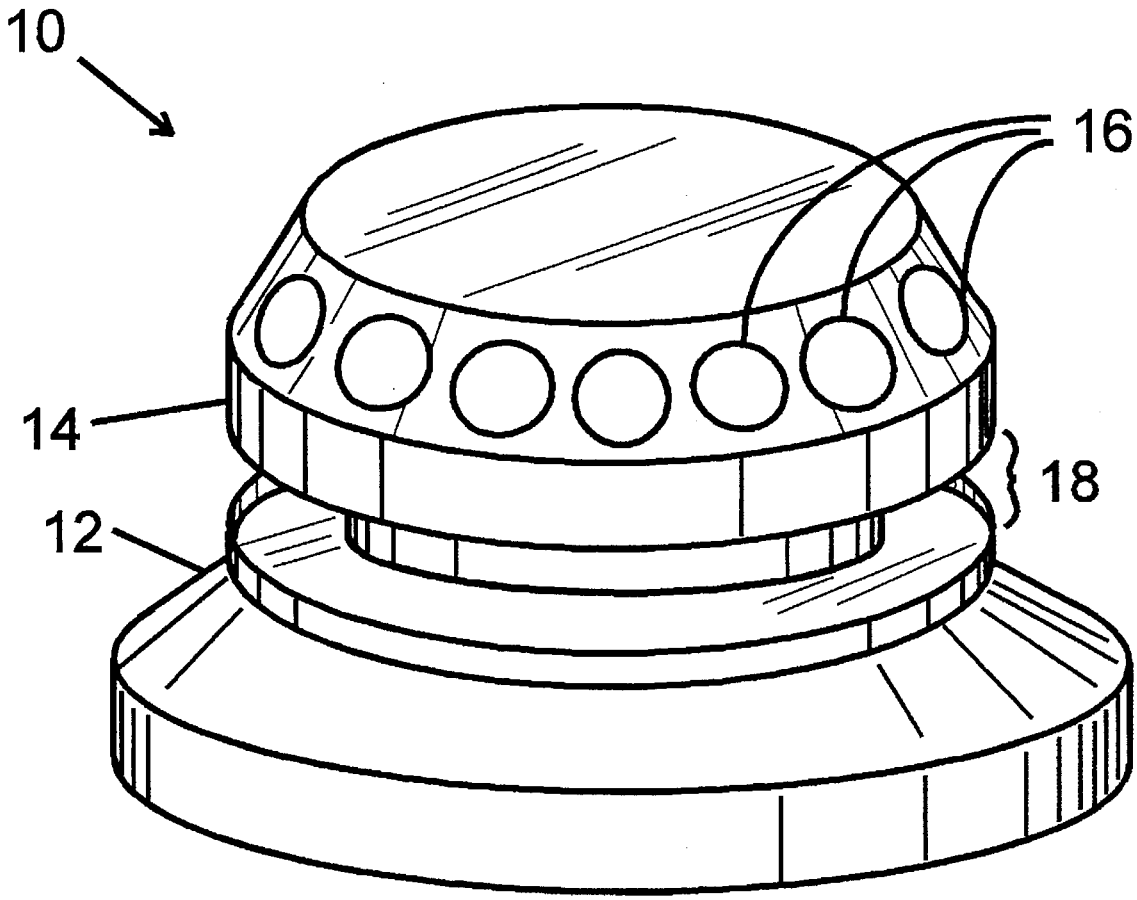
FIG. 1 shows a perspective drawing of the smoke detector of this invention.

FIG. 1 shows an isometric view of a smoke detector of this invention. The same smoke detector is shown in cross-section in FIG. 2. The smoke detector 10 comprises a base 12 that is, in practice, mounted flush against a wall or a ceiling in a room or other space. Other installation positions are not proscribed. A cover 14 encloses the working parts of the smoke detector, and may have holes 16 to admit air into the detector chamber within. The cover 14 may also provide access for ambient air to enter the detector chamber by virtue of its edges being spaced away from contact with the base 12, thereby forming a substantially continuous air passage 18 around the periphery of the cover. In the best mode of this invention, both types of access are present. Ambient air may reach the detector chamber within the smoke detector by either the holes 16 or the passage 18.

A battery power supply (not shown) and all electronic circuitry associated with processing the signal for the smoke detector may be housed within the base 12, thereby making the smoke detector of the best mode independent of external power sources. In permanent installations, especially in locations of problematic accessibility, it may be desirable to provide an outside power source to provide-adequate power over long periods of time.

Figure 2:
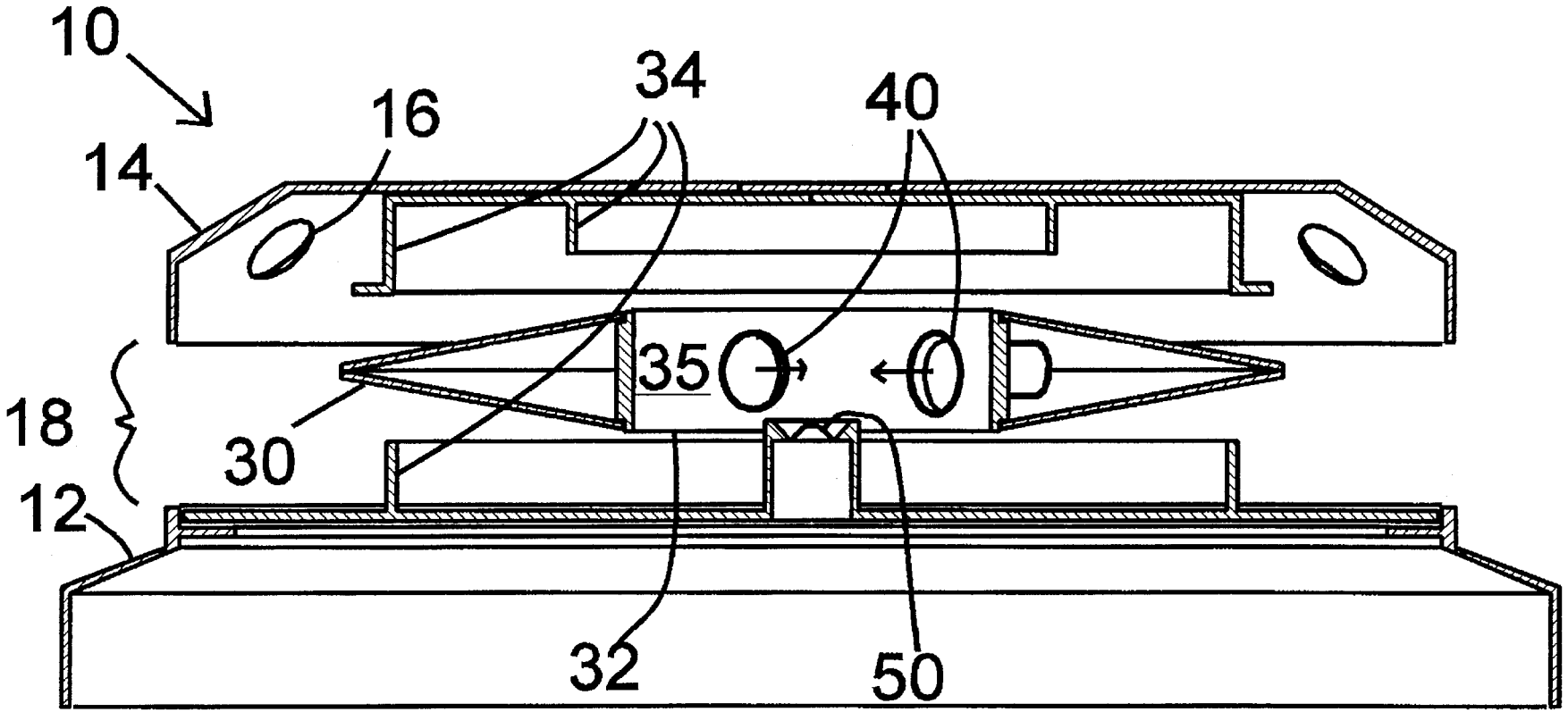
FIG. 2 shows a cross-section of the body of the smoke detector of this invention.

In FIG. 2, a sectional view of the smoke detector 10, one can see the doubly-convex disc-shaped detector cell body 30 with surrounding passages for air being moved by natural convection currents that are always present in every real installation. Arrows A and B represent typical convection currents entering the passages on either side of the detector cell body 30, which houses the detector cell 32. From this figure, it can be seen that the detector cell body is thick in the middle, where the detector cell is located, and thin at the edges. This shape has been herein referred to as doubly-convex disc-shaped, being similar in shape to a double-convex lens, although in practice, it is most easily made up of flat conical frustrums. Natural convection air currents moving through the passages accelerate as the body thickens, thereby efficiently bringing ambient air into the center portion where it may enter the detector cell 32 itself.

The geometry of the detector cell body is symmetrical, so the same effects of acceleration of air flow exist on both the top and the bottom surfaces of this body.

It will also be noted in FIG. 2 that light baffles 34 are present on both the cover element 14 and the base element These baffles are sized and positioned to prevent any ambient light from entering the detector chamber. To further reduce this possibility, the surfaces making up the passages have a flat black finish. In practice, this has been achieved by the use of a flat black paint. It may be possible to provide such a finish during the process of molding the parts for the base, the cover, and the detector cell body.

Now that we have discussed the features that bring the sample to the detector cell while keeping ambient light from entering the detector cell, we shall turn our attention to the components that make up the detector cell. Improvements in the detector cell are, of course, very important to increased sensitivity of the detector. The improvements to the detector cell are complemented by improvements in the electronics of the best mode.

Figure 3:
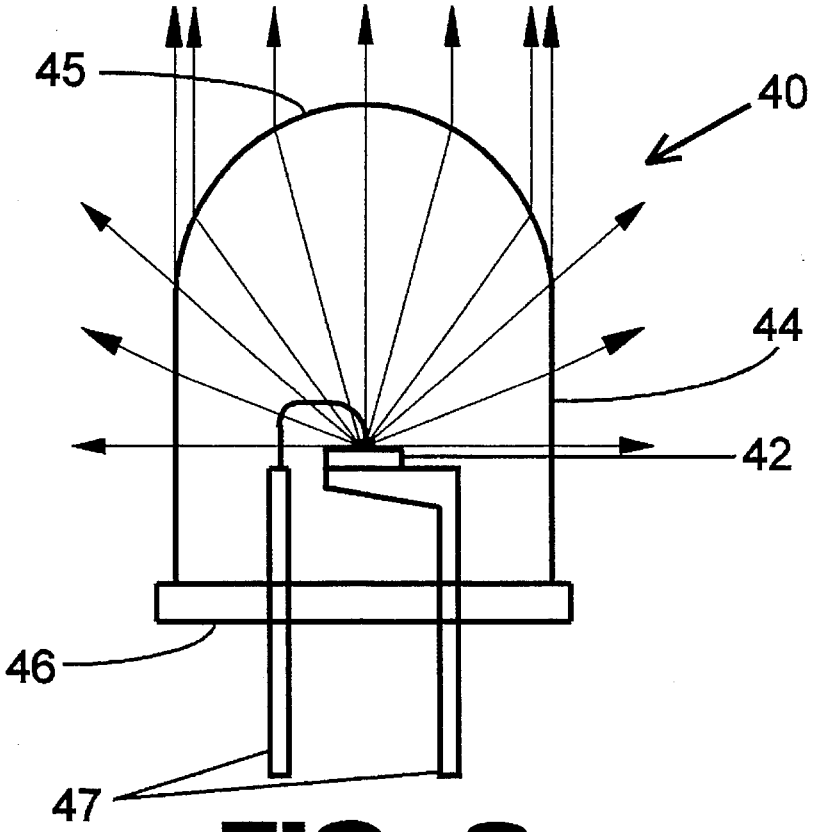
FIG. 3 shows a cross-section of a light-emitting diode.

The detector light source is a light-emitting diode (LED). A typical LED is shown in FIG. 3 and in FIG. 4 in cross-sectional views that illustrate one improvement made relative to the light source to increase the intensity of light injected into the detector chamber.

Figure 4:
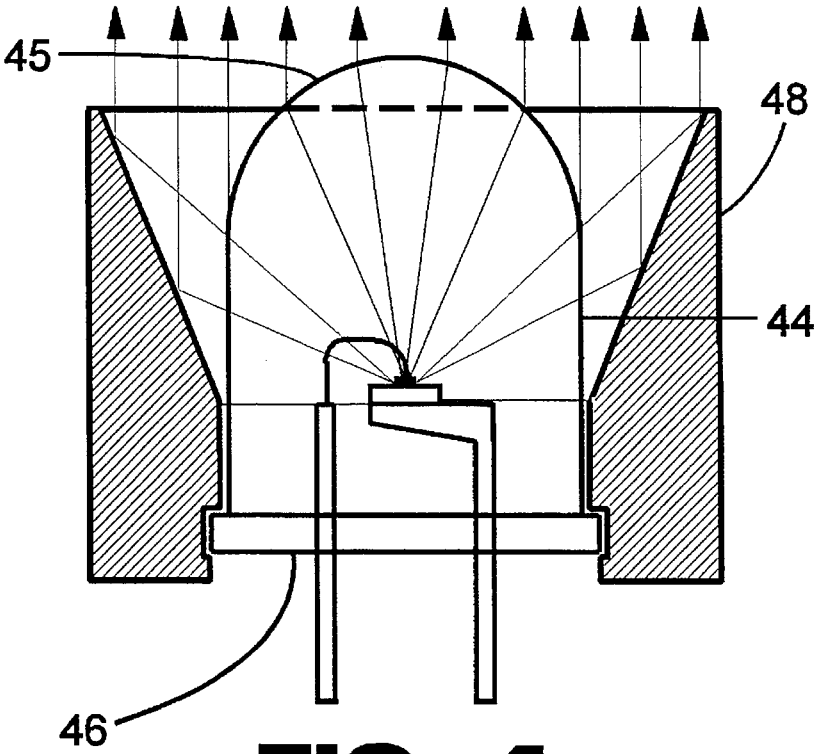
FIG. 4 shows a cross-section of a light-emitting diode with a reflector as used in this invention.

A typical LED 40 comprises a small plate 42 of semiconductor material that emits light (shown as rays, with arrowheads) when a d.c. (direct current) voltage is applied. This plate is sealed in a substantially cylindrical glass or plastic envelope 44, typically with a spheric lens on one end 45 to direct light passing therethrough in a generally axial direction, and a flat profile on the other end 46, which serves as a base from which the two electrical leads 47 extend for applying voltage to the diode. It was estimated that approximately eighty percent of the light from the plate 42 was radiated in a substantially lateral direction relative to the axis of the envelope 44. Whereas the desire was to direct more light in an axial direction, a reflector 48, as shown in FIG. 4, was fitted to surround the LED to redirect the large amount of otherwise misdirected light. This reflector is a simple and effective solution to this problem and it is one that has not been applied in the technology of prior art smoke detectors. Now, instead of losing 80 percent of the emitted light, we are utilizing more of the emitted light. The improvement may be estimated as being a four-fold improvement in sensitivity because of the increased light utilization.

A second feature of the detector chamber is to make the chamber in the form of a right circular cylinder with multiple such LED light sources spaced around the perimeter, thereby to intensely illuminate a region of space in the center of the cylinder. It will be seen later that operating these light sources by connecting them in series will reduce the level of power consumption required for multiple LEDs.

A natural result that arises from the geometry of the placement of the light sources is the placement of a photocell 50 to detect light scattered by any smoke that may enter the detector chamber. To be similarly placed with respect to each of the light sources, it was natural to position the photocell such that the axis of its detection zone would be perpendicular to the axis of each of the light sources so that no light from any of the sources 40 could impinge directly on the photocell 50. A small amount of reflected light may reach the photocell, but provisions are made to make this background signal constant.

One could provide as many light sources as would fit around the circumference of the detector chamber to improve the sensitivity of the smoke detector, but these light sources consume power. Three light sources equally spaced around the periphery of the detector chamber 32 with the principal axis of their light (shown as a ray, with an arrowhead) directed radially to converge at the center of the detector chamber, which center is also in alignment with the centerline of a photocell 50 that is positioned axially relative to the detector chamber, became the design of choice for practical reasons. A suitable LED was found that operates on a voltage of approximately 1.7 volts. Whereas most battery-powered smoke detectors operate using a 9-volt battery, this voltage would power three of the selected LEDs in the desired series connection. Thus, the detector became potentially three times as sensitive as one having only a single LED light source.

A final mechanical improvement is presented by providing the inner surface 35 of the detector chamber 32 with a mirrored surface. In practice, a suitable reflective wall can be achieved by the technique known alternatively as chemical vapor deposition or vacuum metallizing. Other techniques may be equally suitable. Thus, the fortuitous use of three radially-directed, equally-spaced LEDs now presents a reflective wall opposite each LED. Light impinging upon this wall is reflected to the central region of the detector chamber. It has been determined that adding this reflective surface has increased the sensitivity of the detector of this invention by a factor of six.

Now, before proceeding to a discussion of the electronics being used in the smoke detector of this invention, a summary of the improvements obtained thus far is in order. No improvement in sensitivity can be ascribed to the smoke collection features including the air passages. A four-fold increase in sensitivity may be ascribed to redirecting otherwise lost light from the LED. A-three-fold increase in sensitivity can be ascribed to the use of three light sources. A six-fold increase in sensitivity can be ascribed to the mirrored detector cell wall. Taken together, these individual improvements may be combined to show one should expect an estimated seventy-two-fold (i.e., 4×3×6=72) increase in sensitivity attributable to the mechanical improvements in the detector chamber itself. In fact, tests using Underwriter's Laboratories UL® STANDARD 217 have indicated a sensitivity 100 times that of competing standard smoke detectors is attainable. That is, the smoke detector of this invention can sense smoke at concentrations one one-hundredth as concentrated as the threshold detection level of smoke detectors in common use today.

A highly significant portion of this invention lies in the method used to power the LEDs used in the detector chamber. It was believed important to minimize noise that might be introduced to the system by a variation in the intensity of light generated for the detection system. Such variation is considered "light noise", as it manifests itself as signal noise in the detector circuit and arises from variations in the light source.

One source of light noise is a variation in the light output of an LED as a result of a change in temperature of the LED. Certainly, ambient temperatures where smoke detectors are installed are subject to change with time. Also, the mere fact that light energy is produced results in some heating within the LED, causing a temperature rise and thereby altering the light output. In more technical terms, the value of V-forward for the diode is affected by temperature; as temperature increases, V-forward decreases, adversely affecting the light output. It was found that the light output would remain stable if the applied voltage was held stable. Even when three LEDs were connected in series, it was found that a stable light output prevailed if the voltage applied was precisely regulated, even though temperature changes had to exist. Whereas precisely regulated voltage is available to drive the LEDs to eliminate light noise, it is preferred to use the same precisely regulated voltage as a voltage source to drive the photocell detector. It is believed that this is the first time that so stable a condition has been imposed in smoke detector technology, as well as in any application of LEDs, and it is a key element to obtaining ultra-high sensitivity in an optical smoke detector.

Figure 5:
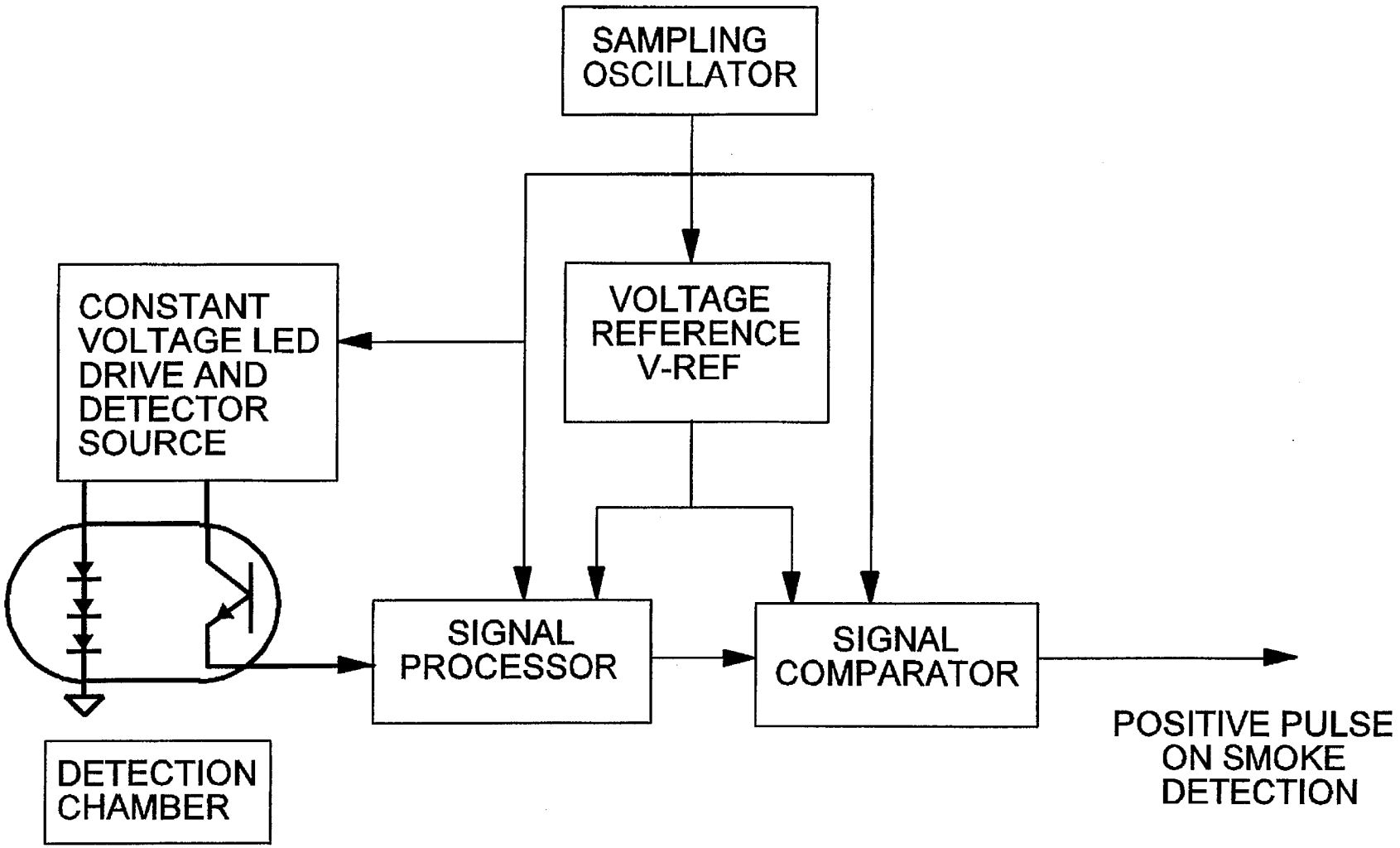
FIG. 5 shows a block diagram of the electronic features of this invention.

FIG. 5 shows a block diagram for the electronic parts for the detector circuit. A SAMPLING OSCILLATOR provides a brief pulse on a periodic basis to turn on the rest of the circuitry, which is otherwise not powered. During each power pulse an integrated circuit is activated that provides a temperature compensated constant voltage output that is used as a VOLTAGE REFERENCE (V-ref) that is used variously in other parts of the circuit.

In one case, V-ref is used as a comparison voltage for the precise regulating of a constant voltage for operating the LEDs and the detector photocell. A comparator maintains the precisely regulated voltage supplied to the LED circuit at a value in constant proportion to V-ref. This is done by the CONSTANT VOLTAGE LED DRIVE AND DETECTOR SOURCE.

V-ref is also supplied to the SIGNAL PROCESSOR, which receives and amplifies any signal from the photocell in the DETECTION CHAMBER. The SIGNAL PROCESSOR uses V-ref as a calibration reference to provide a standard for setting the appropriate level of amplification.

V-ref is also used in the SIGNAL COMPARATOR wherein the amplified signal from the SIGNAL PROCESSOR is compared to V-ref to determine whether an alarm output signal pulse should be applied to the output.

The block diagram of FIG. 5 does not show the alarm circuitry that acts upon the positive pulse smoke detection signal because that circuitry is commonly available from prior art. Only the new technology is illustrated.

Figure 6:
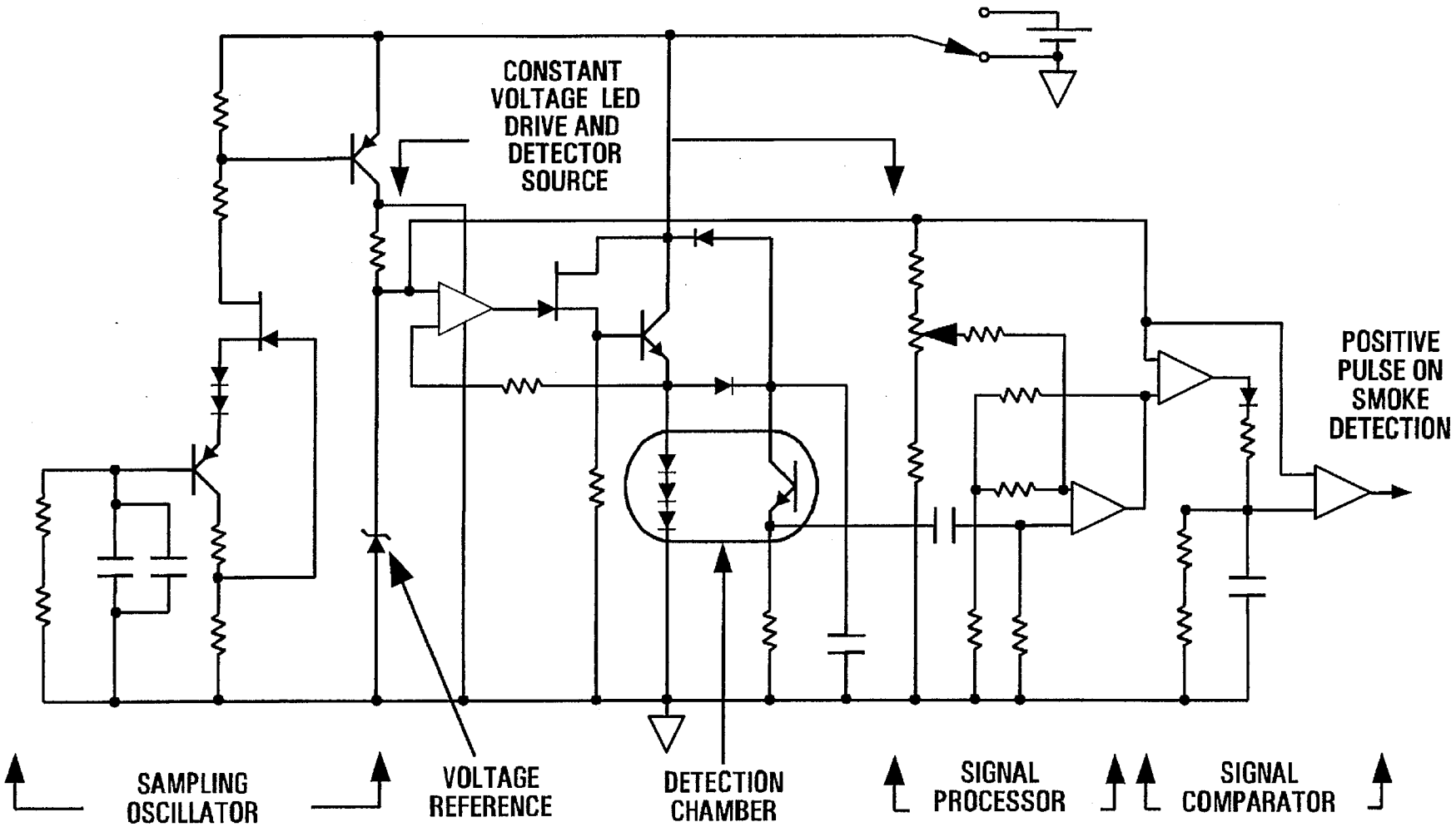
FIG. 6 shows a schematic diagram of a circuit that will perform the electronic functions featured in this invention.

A schematic diagram for an electronic circuit that will perform the functions required for the features of this invention is presented in FIG. 6. This circuit has all of the elements described in the block diagram of FIG. 5 and this circuit has been built and operates completely satisfactorily.

While we have shown and described only limited principal embodiments in accordance with the present invention, we do not wish to be limited to the details shown and described herein, but we intend to cover all such changes and modifications as are encompassed by the scope of the claims appended hereto.

We claim:

1. A smoke detector of the light-scattering type having a detection chamber comprising:

a. a cylindrical wall having a continuous mirrored internal surface that reflects nearly 100% of light impinging thereupon, said cylindrical wall having an axis;

b. a photocell having a field of detection extending along said axis within said detection chamber; and c. means to introduce a beam of light through said wall in a plane perpendicular to said axis, wherein said beam is repeatedly reflected by different parts of said continuous mirrored wall, forming a plethora of light beams, both direct and reflected, that intersect and cross in a myriad of angles, while remaining substantially in said plane, thereby to brightly illuminate the central region of said chamber to provide light that is scattered by smoke present in said detection chamber, some of said light is scattered at an angle of substantially 90° from said light beams and is thus detected by said photocell which provides an output signal.

2. The smoke detector of claim 1 wherein said continuous mirrored internal surface is interrupted only by openings that provide means for one or more light sources to introduce light into said detection chamber.

3. The smoke detector of claim 2 wherein such openings for introducing light wherein the principal axis of the collection of rays of light introduced is directed radially toward the center of said detection chamber.

4. The smoke detector of claim 1 wherein three light sources are spaced in a co-planar fashion at equal intervals around the circumference of said detection chamber in spaced openings for the introduction of light into said detection chamber in a radial direction relative to said chamber.

5. The smoke detector of claim 4 wherein each said light source is a light-emitting diode (LED).

6. The smoke detector of claim 5 wherein each said LED is fitted with a reflector ring to re-direct light emitted transverse to the major axis of the LED to a direction substantially aligned with said major axis.

7. The smoke detector of claim 6 wherein said LEDs are connected in series and are powered by a single power source of precisely-regulated constant voltage, thereby to present to said detector a very low degree of baseline temperature drift of the LEDs.

8. A smoke detector having a doubly-convex disc-shaped body portion and a tapering then expanding air passage on either side of said body portion, the shape of each said air passage being effected by said convex body portion and a base on one side and a cover on the other side of said body, thereby to utilize a venturi effect regarding air flow through said passages and around said convex body portion, and wherein a smoke detection cell is adjacent to and open to the central (i.e., high-velocity) region of each said tapering then expanding air passage, thereby to encourage exchange of gases in the detector with ambient gases carried by natural ambient convection through each air passage.

9. The smoke detector of claim 8 wherein said base and cover each also includes a light baffle to prevent ambient light from entering said detection cell.

* * * * *